US011555629B2

(12) United States Patent
Suryawanshi et al.

(10) Patent No.: US 11,555,629 B2
(45) Date of Patent: Jan. 17, 2023

(54) HVAC SYSTEM WITH BAFFLE IN SIDE DISCHARGE CONFIGURATION

(71) Applicant: Johnson Controls Technology Company, Auburn Hills, MI (US)

(72) Inventors: Sumedh J. Suryawanshi, Pune (IN); Kirankumar A. Muley, Pune (IN); Gaurav S. Patil, Pune (IN); Pankaj B. Avhad, Nashik (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 165 days.

(21) Appl. No.: 16/795,283

(22) Filed: Feb. 19, 2020

(65) Prior Publication Data

US 2021/0254855 A1 Aug. 19, 2021

(51) Int. Cl.

| | |
|---|---|
| ***F24F 13/02*** | (2006.01) |
| ***F24F 13/08*** | (2006.01) |
| *F24F 7/06* | (2006.01) |

(52) U.S. Cl.

CPC ..... *F24F 13/0236* (2013.01); *F24F 13/081* (2013.01); *F24F 7/065* (2013.01)

(58) Field of Classification Search

CPC ..... F24F 13/081; F24F 13/0236; F24F 13/08

USPC ..... D23/387, 393

See application file for complete search history.

(56) References Cited

U.S. PATENT DOCUMENTS

| | | | | |
|---|---|---|---|---|
| 2,963,783 | A * | 12/1960 | Field | B21C 37/28 428/581 |
| 4,995,426 | A * | 2/1991 | Hinden | F24F 13/081 428/167 |
| 5,006,743 | A * | 4/1991 | King | H02K 5/10 310/89 |
| D342,782 | S * | 12/1993 | Anderson | D23/263 |
| 5,320,088 | A | 6/1994 | Nester | |
| 9,675,726 | B2 | 6/2017 | Lunman et al. | |
| 9,982,912 | B2 | 5/2018 | Wagers et al. | |
| 10,670,280 | B2 * | 6/2020 | Wu | F24F 11/65 |
| 2008/0318514 | A1 * | 12/2008 | Fettkether | F24F 13/0236 454/330 |
| 2010/0163209 | A1 * | 7/2010 | Eguchi | F24F 13/30 165/41 |
| 2014/0026608 | A1 | 1/2014 | Manzo et al. | |

FOREIGN PATENT DOCUMENTS

CN 105536495 A 5/2016

* cited by examiner

*Primary Examiner* — Avinash A Savani
*Assistant Examiner* — Ryan L Faulkner
(74) *Attorney, Agent, or Firm* — Fletcher Yoder, P.C.

(57) ABSTRACT

A heating, ventilation, and/or air conditioning (HVAC) system includes a discharge section housing forming a chamber, a first opening formed in the discharge section housing such that the chamber is configured to receive an air flow from a blower of the HVAC system via the first opening, and a second opening formed in the discharge section housing such that the second opening is positionally offset to the first opening. The chamber is configured to discharge the air flow through the second opening. The HVAC system also includes a guide extending across the chamber and sloping toward the second opening such that the guide is configured to direct the air flow from the first opening toward the second opening.

24 Claims, 7 Drawing Sheets

HVAC SYSTEM WITH BAFFLE IN SIDE DISCHARGE CONFIGURATION

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light, and not as admissions of prior art.

HVAC systems are utilized in residential, commercial, and industrial environments to control environmental properties, such as temperature and humidity, for occupants of the respective environments. An HVAC system may control the environmental properties through control of an air flow delivered to the environment. For example, the HVAC system may circulate a refrigerant and place the refrigerant in a heat exchange relationship with a supply air flow to condition the supply air flow before it is discharged to the conditioned environment. In certain embodiments, the HVAC system may have a chamber or plenum through which the supply air flow is directed. For example, the HVAC system may have a blower configured to force or draw air through the chamber toward an opening, such as a discharge opening. However, in some circumstances, the air flow may be not be directed efficiently through the chamber and toward the opening. As a result, the blower may operate at a higher operating level to force air flow through the chamber at a desirable flow rate, and a cost associated with operating the HVAC system may therefore increase.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a discharge section housing forming a chamber, a first opening formed in the discharge section housing such that the chamber is configured to receive an air flow from a blower of the HVAC system via the first opening, and a second opening formed in the discharge section housing such that the second opening is positionally offset to the first opening. The chamber is configured to discharge the air flow through the second opening. The HVAC system also includes a guide extending across the chamber and sloping toward the second opening such that the guide is configured to direct the air flow from the first opening toward the second opening.

In one embodiment, a heating, ventilation, and/or air conditioning (HVAC) unit includes a discharge chamber having a first wall defining an opening and a second wall connected to the first wall and defining a discharge opening, a blower coupled to the first wall and configured to direct air into the discharge chamber via the opening, and a baffle plate disposed within the discharge chamber and extending along the first wall. The baffle plate is positioned at an oblique angle relative to the second wall to deflect the air within the discharge chamber toward the discharge opening.

In one embodiment, a discharge section of a heating, ventilation, and/or air conditioning (HVAC) unit includes a first wall defining a first opening configured to receive an air flow from a blower of the HVAC unit, a second wall coupled to the first wall and defining a second opening configured to discharge the air flow from the discharge section, a base panel coupled to the first wall and the second wall, and a baffle plate coupled to the first wall and the second wall and disposed at an acute angle relative to the base panel to deflect the air flow within the discharge section toward the second opening.

DRAWINGS

Various aspects of the present disclosure may be better understood upon reading the following detailed description and upon reference to the drawings, in which.

DETAILED DESCRIPTION

Figure 1:
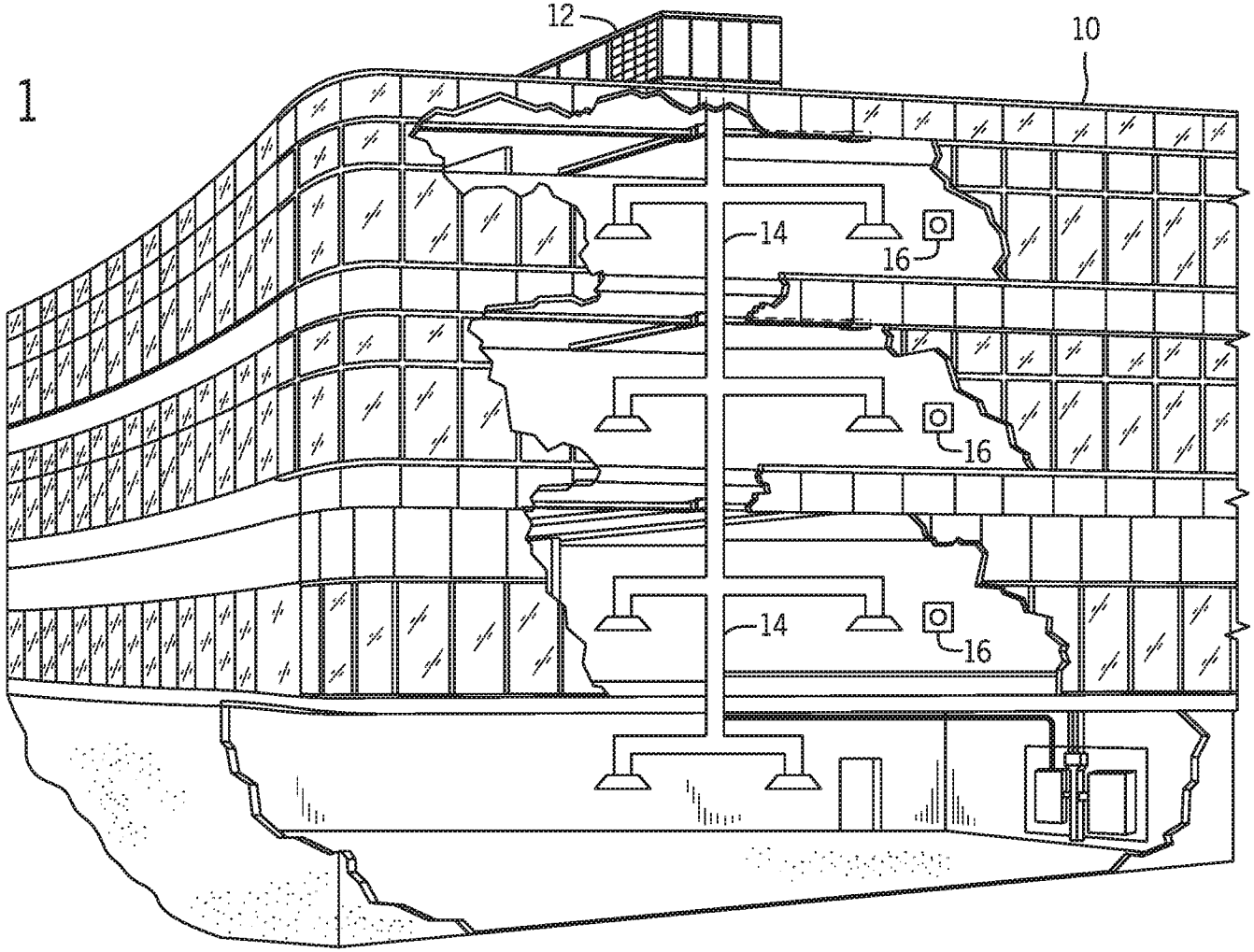
FIG. 1 is a perspective view of an embodiment of a heating, ventilation, and/or air conditioning (HVAC) system for building environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system configured to condition air flowing through the HVAC system. In some embodiments, air is directed through various chambers, sections, or plenums of the HVAC system. The various sections may include a condensing section, an evaporating section, a heating section, a discharge section, or any combination thereof. The circulation of the air through the sections may enable the HVAC system to condition the air in a variety of manners, including cooling, heating, dehumidification, and so forth.

In some embodiments, the HVAC system may include a housing having a side discharge configuration. As used herein, a side discharge configuration refers to an HVAC system configuration in which a conditioned air flow is direct out of the HVAC system laterally via an opening in a side wall of the HVAC system instead of, for example, downward via an opening in a bottom panel of the HVAC system. For example, the HVAC system may include a discharge plenum, chamber, or section having a side wall that may be generally perpendicular to a flow path of air entering the discharge chamber. After entering the discharge chamber, the air may deflect off walls of the discharge chamber before exiting through an opening or outlet of the side wall. In some instances, the deflection of the air off the walls may cause the air to circulate within the discharge chamber, rather than to flow through the opening of the side wall and out of the discharge chamber. Thus, the air may not flow out of the discharge chamber at a desirable flow rate, thereby reducing a performance or efficiency associated with circulating the air through the HVAC system. To this end, a blower or other component of the HVAC system directing the air therethrough may run at a higher operating mode or level in order to direct the air out of the discharge chamber at a desirable flow rate, thereby increasing a cost associated with operating the HVAC system.

Thus, it is presently recognized that guiding an air flow toward the opening formed in the side wall of the discharge chamber may increase an operational efficiency of the HVAC system. For example, embodiments of the present disclosure may improve an efficiency of a blower that forces the air flow through the discharge chamber by reducing recirculation or entrapment of air within the chamber. As discussed below, present embodiments include a baffle or baffle plate positioned within the discharge chamber to direct the air flow toward an opening of the discharge chamber, such as the opening in the side wall of the discharge chamber. As an example, the baffle may be angled so as to deflect the air flow toward the opening, rather than toward another wall of the discharge chamber. In this way, the air flow passing through the discharge chamber is discharged out of the discharge chamber at a higher flow rate. For this reason, the blower may run at a lower operating level in order to achieve a desirable flow rate of the air flow out of the discharge chamber. Although the present disclosure primarily discusses implementation of a baffle within a chamber of a discharge section having a side discharge configuration, it should be noted that the baffle may be implemented within any suitable chamber, plenum, or section of an HVAC system, such as in a discharge section having a different discharge configuration and/or in any other type of section of the HVAC system through which air may flow.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
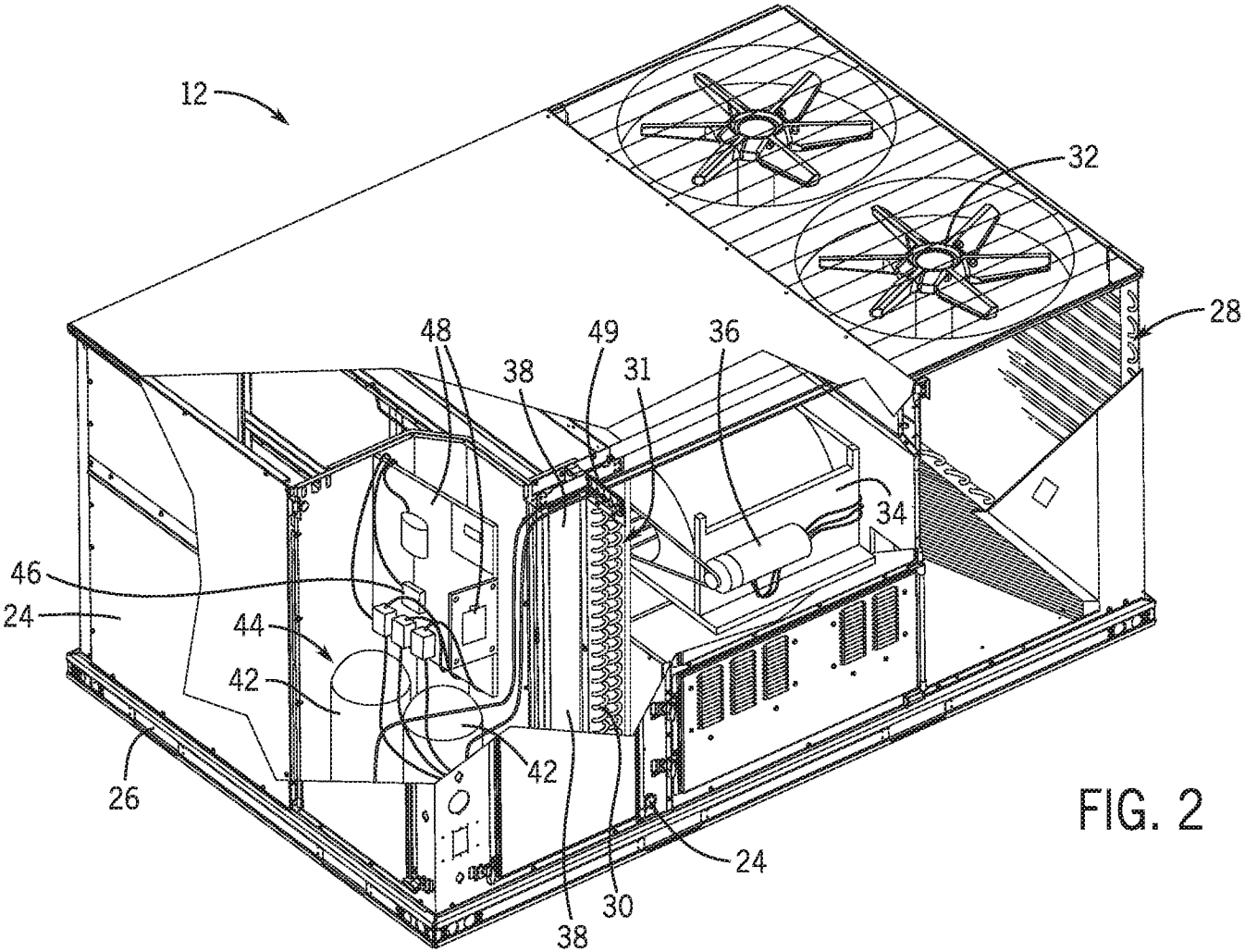
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be noted, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
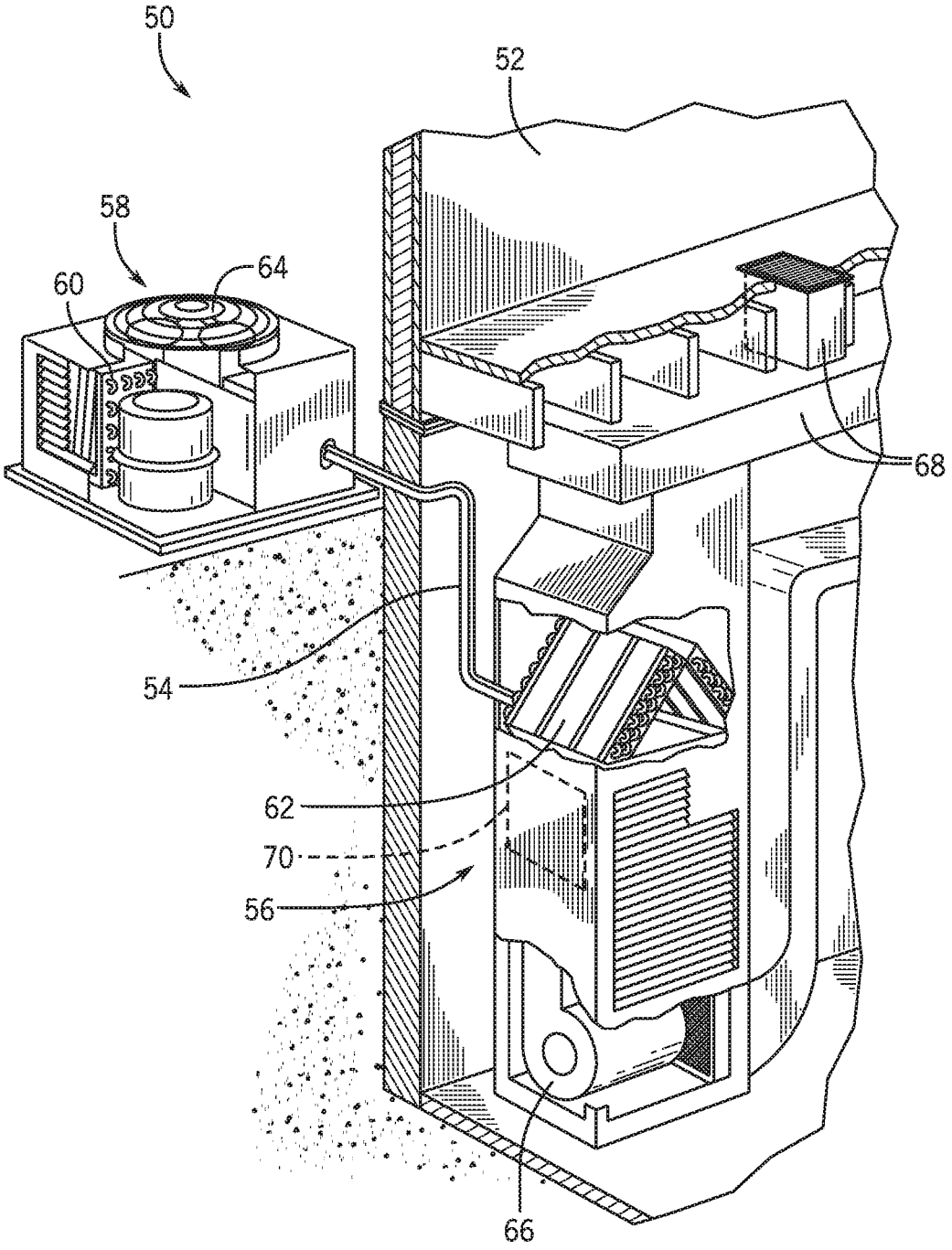
FIG. 3 is a perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
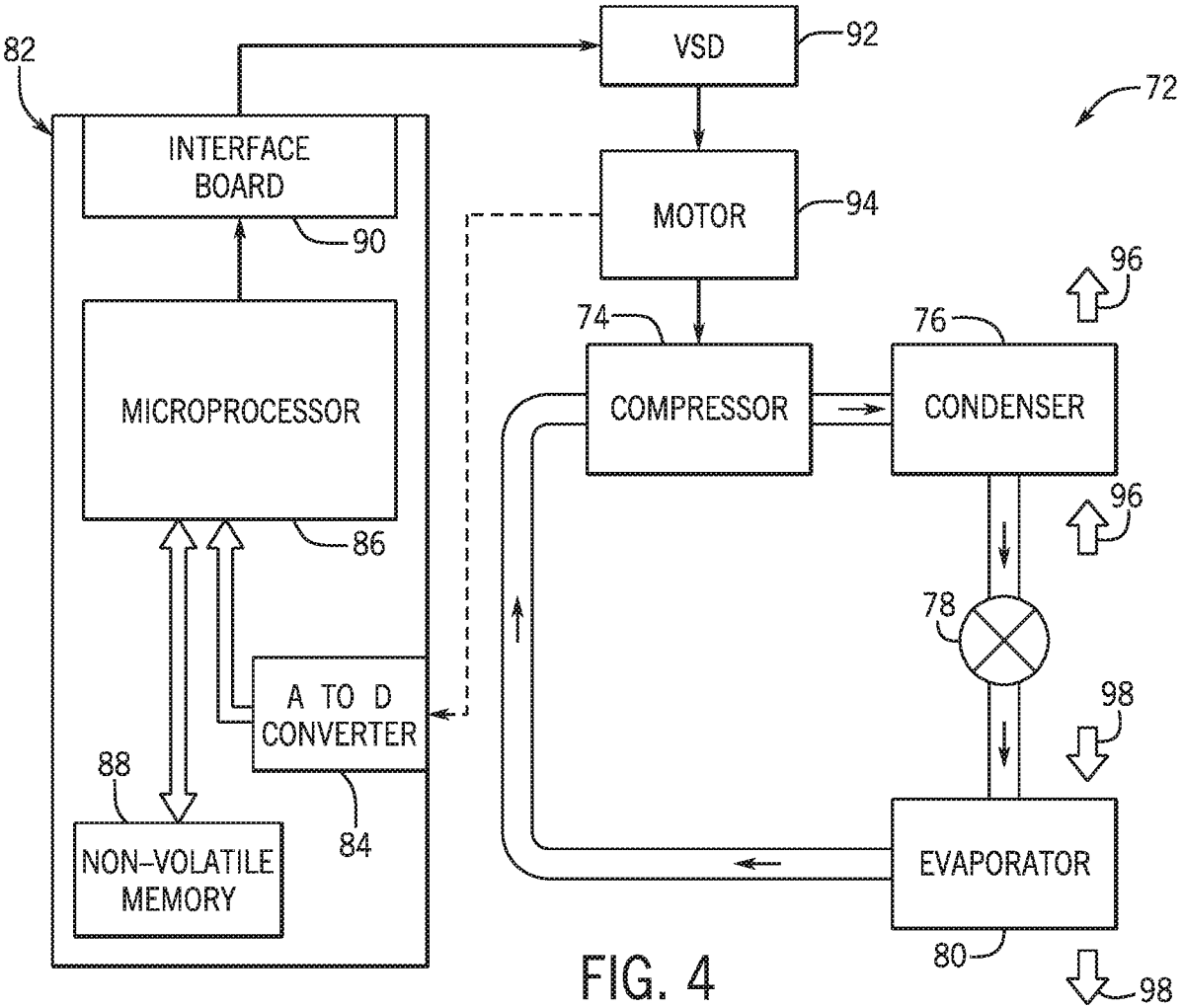
FIG. 4 is a schematic of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be noted that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system may have a chamber and a component, such as a blower, configured to force or draw an air flow into the chamber. In some embodiments, the chamber may be defined by walls of the HVAC system. For example, a first wall defining the chamber may have a first opening through which the blower directs the air flow into the chamber and toward a second wall of the chamber that is opposite the first wall. In some embodiments, the chamber may be a discharge section of the HVAC system, and the chamber may have a third wall having a second opening through which the air flow exits the chamber. For example, the third wall having the second opening may be a side wall of the HVAC system, and the air flow may exit the chamber out of the side of the HVAC system to flow toward a space conditioned by the HVAC system in order to condition the space.

A baffle plate may be disposed within the chamber to direct the air flow toward the second opening and out of the chamber and to reduce recirculation of air within the chamber. By way of example, the baffle plate may be angled so as to deflect the air flow within the chamber, such as toward the second opening in the third wall. More specifically, the air flow directed into the chamber via the first opening in the first wall may be deflected and/or directed by the baffle toward the second opening in the third wall. The baffle may also direct and/or deflect any other air within the chamber toward the second opening in the third wall. In this manner, the baffle plate may increase a flow rate of the air through and out of the chamber. Thus, the baffle plate may improve a performance of the HVAC system, such as an efficiency of the blower directing the air through the HVAC system.

Figure 5:
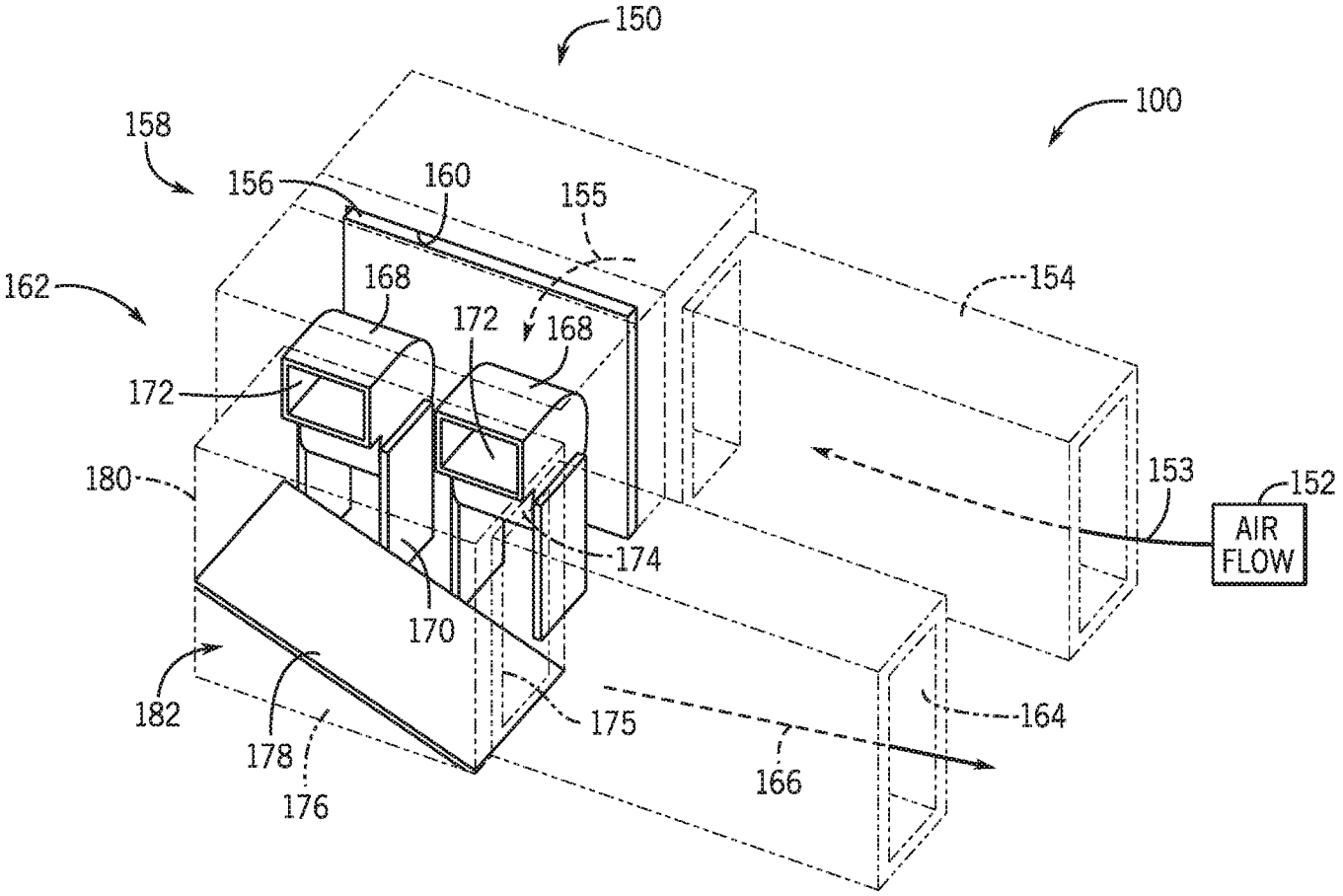
FIG. 5 is a perspective view of an embodiment of a portion of an HVAC system having a discharge section with a baffle plate, in accordance with an aspect of the present disclosure.

FIG. 5 is a perspective view of an embodiment of an HVAC unit 100 having an air flow passage 150 extending therethrough. The HVAC unit 100 may be an embodiment of the HVAC unit 12 and/or of the residential heating and cooling system 50, and the air flow passage 150 may enable an air flow 152 to be directed through the HVAC unit 12, such as for conditioning and delivery to the building 10. It should be noted that certain features of the HVAC unit 100 are transparent for visualization purposes. The HVAC unit 100 may receive the air flow 152 directed into the air flow passage 150 in a first flow direction 153. The air flow 152 may be outdoor air received from an ambient environment and/or return air received from a space conditioned by the HVAC unit 100. For instance, the HVAC unit 100 may have an intake section or chamber 154 configured to receive the air flow 152 entering the air flow passage 150. In some embodiments, the intake section 154 may direct the air flow 152 in a second flow direction 155 toward an evaporator 156, which may be positioned in an intermediate section or chamber 158 of the HVAC unit 100. The evaporator 156 may be configured to cool the air flow 152. By way of example, the HVAC unit 100 may have a refrigeration circuit configured to circulate a refrigerant, and the evaporator 156 may receive cooled refrigerant and place the cooled refrigerant in a heat exchange relationship with the air flow 152. The cooled refrigerant may absorb thermal energy or heat from the air flow 152, thereby cooling the air flow 152. In the illustrated embodiment, the intermediate section 158 further includes a filter 160 positioned upstream of the evaporator 156 relative to the second flow direction 155 of the air flow 152. The filter 160 may remove debris, such as dirt and dust, from the air flow 152 before the air flow 152 is directed across the evaporator 156. In additional or alternative embodiments, the intermediate section 158 may include other features or components configured to condition the air flow 152, including a furnace, a reheat heat exchanger, another suitable component, or any combination thereof.

The HVAC unit 100 further includes a discharge section or chamber 162 configured to discharge the air flow 152 out of the air flow passage 150. In some implementations, the discharge section 162 may direct the air flow 152 to ductwork 164 in a third flow direction 166. The ductwork 164 may deliver the air flow 152 to the space conditioned by the HVAC unit 100 and/or may distribute the air flow 152 to other ductwork that may be fluidly coupled to the ductwork 164. In some embodiments, the HVAC unit 100 may receive the air flow 152 as return air flow after the air flow 152 circulates through the conditioned space. The HVAC unit 100 may then condition the return air flow and deliver the conditioned air flow as supply air flow to the space.

The HVAC unit 100 includes blowers 168 that are disposed in the intermediate section 158 and configured to direct the air flow 152 into the discharge section 162. The blowers 168 may draw the air flow 152 into the intake section 154 and through the intermediate section 158, and the blowers 168 may force the air flow 152 from the intermediate section 158 into the discharge section 162. For instance, the first wall 170 may partially define the intermediate section 158, and the intermediate section 158 may be fluidly coupled to the discharge 162. Although there are two blowers 168 in the illustrated HVAC unit 100, additional or alternative embodiments of the HVAC unit 100 may have any suitable number of blowers 168, including one blower or three or more blowers 168. Further, in the illustrated embodiment, the discharge section 162 is shown in a side discharge configuration, in which the blowers 168 do not direct the air flow 152 directly toward an outlet of the discharge section 162 and the ductwork 164.

In the side discharge configuration, the air flow 152 exits the HVAC unit 100 through a side panel of the HVAC unit 100 instead of, for example, a bottom panel of the HVAC unit 100. For instance, the discharge section 162 may include a first wall 170, which may be a side wall. The first wall 170 may define openings 172 through which the blowers 168 may direct the air flow 152 from the intermediate section 158 into the discharge section 162. The ductwork 164 may be fluidly coupled to the discharge section 162 at a second wall 174 of the discharge section 162, which may also be a side wall. Specifically, the second wall 174 defines a discharge opening 175 that fluidly couples the discharge section 162 with the ductwork 164, and the second wall 174 may be coupled to the first wall 170 such that the discharge opening 175 is positionally offset (e.g., oriented crosswise, oriented transverse) to the openings 172.

The blowers 168 may direct the air flow 152 toward a third wall 176 or side wall that is disposed opposite the first wall 170 of the discharge section 162, rather than toward the second wall 174 and the ductwork 164. As an example, the discharge section 162 may have a rectangular prismatic shape in which the second wall 174 is respectively coupled to the first wall 170 and the third wall 176 at approximately 90 degrees such that the openings 172 are orientated substantially perpendicularly relative to the discharge opening 175. Thus, the first wall 170 is oriented generally parallel with the third wall 176. In this manner, the blowers 168 may direct the air flow 152 substantially perpendicularly toward the third wall 176 and substantially parallel to the second wall 174, rather than directly toward the second wall 174 and the discharge opening 175 of the second wall 174.

The discharge section 162 may also include a baffle plate 178 configured to deflect the air flow 152 toward the discharge opening 175 in the second wall 174 and toward ductwork 164. By way of example, the baffle plate 178 may direct the air flow 152 forced into the discharge section 162 by the blowers 168 toward the discharge opening 175 of the second wall 174. Further, a center of the openings 172 may be positioned above a center of the discharge opening 175 and the baffle plate 178 may be positioned below the openings 172. Therefore, air flow 152 directed into the discharge section 162 may flow through the openings 172 and may flow toward the baffle plate 178 via gravity. The baffle plate 178 may then deflect the air flow 152 toward the discharge opening 175. In this way, the baffle plate 178 improves the flow of the air flow 152 toward the discharge opening 175 of the second wall 174 and thereby increases a flow rate of the air flow 152 exiting the discharge section 162. Indeed, the baffle plate 178 may reduce generation of vortices or other swirls of air that may inhibit flow of the air flow 152 out of the discharge section 162. In other words, the air flow 152 is more readily directed out of the discharge section 162 rather than inadvertently recirculated within the discharge section 162. As such, the baffle plate 178 may increase an efficiency of the HVAC unit 100 delivering the air flow 152. As an example, the blowers 168 may operate at a lower operating level to achieve a desirable flow rate of the air flow 152 exiting the discharge section 162. Therefore, the baffle plate 178 may reduce a cost associated with operating the HVAC unit 100 to supply the air flow 152 to a conditioned space. As another example, the baffle plate 178 may increase a flow rate of the air flow 152 directed out of discharge section 162. Therefore, the baffle plate 178 may enable the HVAC unit 100 to condition the space with the air flow 152 more efficiently.

As illustrated in FIG. 5, the baffle plate 178 may be positioned to extend across the discharge section 162 along the first wall 170 and at an oblique angle relative to the second wall 174. Additionally, the baffle plate 178 may be positioned at an oblique angle relative to a fourth wall 180 of the discharge section 162 that is connected to the first wall 170 and the third wall 176 and is disposed opposite the second wall 174. In this manner, the fourth wall 180 at least partially defines the discharge section 162 and the baffle plate 178 is sloped downward toward the discharge opening 175. The baffle plate 178 may be coupled to the first wall 170, the second wall 174, the third wall 176, the fourth wall 180, or any combination thereof. In certain embodiments, the baffle plate 178 may sealingly engage with the first wall 170, the second wall 174, the third wall 176, and the fourth wall 180, thereby defining a space 182 underneath the baffle plate 178. The baffle plate 178 may substantially block the air flow 152 from flowing through or to the space 182. In this manner, the baffle plate 178 reduces a volume of the discharge section 162 through which the air flow 152 may circulate, which may reduce the induction of vortices or swirls of air that may inhibit the air flow 152 exiting the discharge section 162

It should be noted that the HVAC unit 100 may not have any additional components disposed in the discharge section 162 other than the baffle plate 178. That is, the discharge section 162 does not include any additional heat exchanger tubes, coils, blowers, passages, or so forth, that may increase a resistance for air to flow through the discharge section 162 and thereby reduce the flow rate of the air flow 152 through the discharge section 162. In other words, positioning the baffle plate 178 within the discharge section 162 in the manner described herein, without additional components within the discharge section 162, may increase the flow rate of the air flow 152 exiting the HVAC unit 100.

Figure 6:
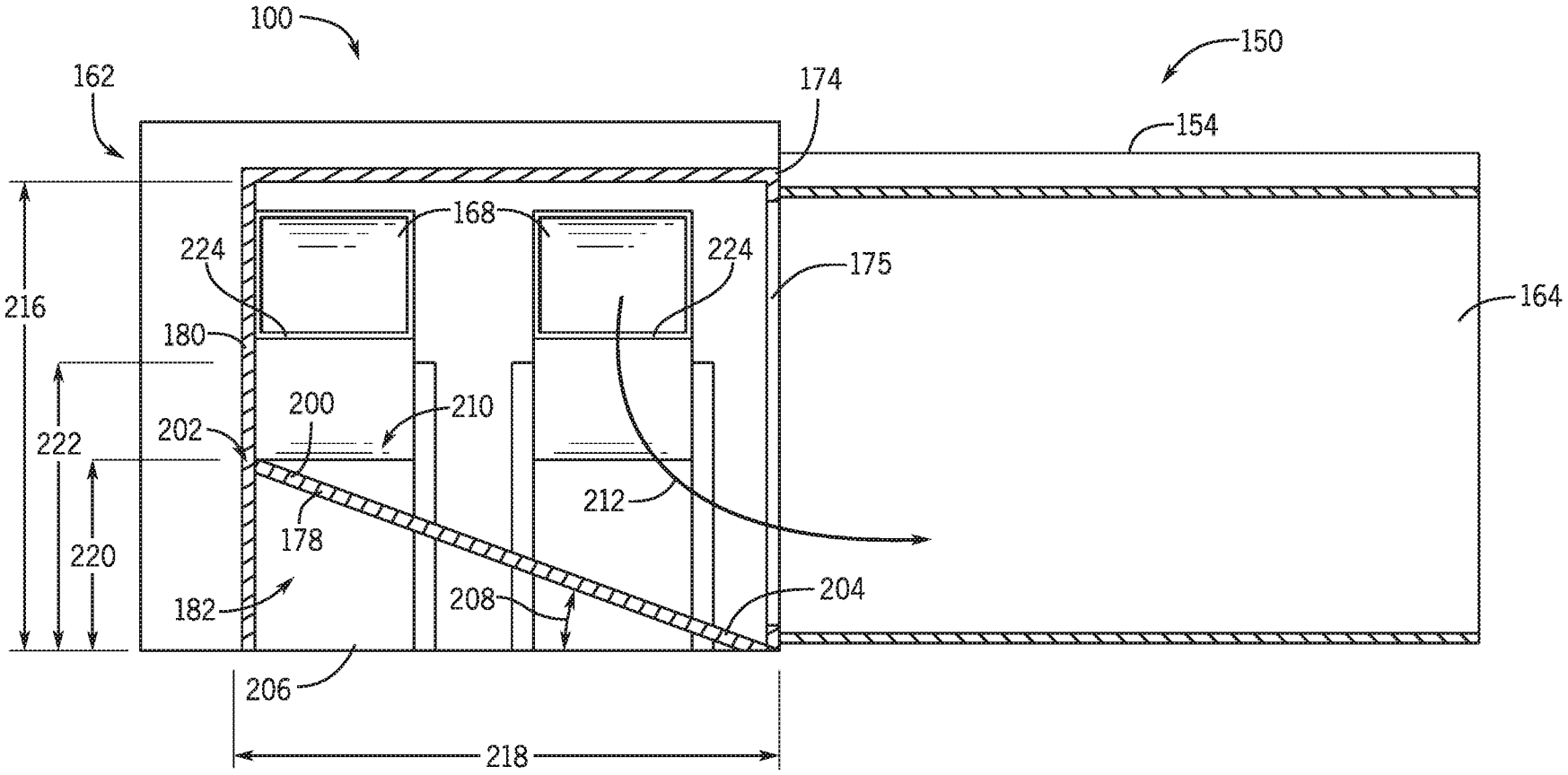
FIG. 6 is a side view of an embodiment of a portion of an HVAC system having a discharge section with a baffle plate, in accordance with an aspect of the present disclosure.

FIG. 6 is a side view of an embodiment of the HVAC unit 100 having the baffle plate 178. In the illustrated embodiment, a first end 200 of the baffle plate 178 is coupled to a middle portion 202 of the fourth wall 180 at an oblique angle, and a second end 204 of the baffle plate 178 is coupled to the second wall 174 at an oblique angle. The second end 204 may also be coupled to a base panel 206 of the discharge section 162 that is coupled to the walls 170, 174, 176, 180. In this manner, the base panel 206 may be positioned transverse or crosswise to the openings 172 and/or the discharge opening 175. The baffle plate 178 may form an angle 208 with the base panel 206. The angle 208 may be an acute angle, such that the slope of the baffle plate 178 faces toward the second wall 174 and the ductwork 164. In this manner, a deflecting surface 210 of the baffle plate 178 may divert the air flow 152 to flow in a fourth flow direction 212 toward the discharge opening 175 defined by the second wall 174. In other words, the baffle plate 178 may be angled to deflect the air flow 152 to flow into the ductwork 164 via the discharge opening 175. For instance, any portion of the air flow 152 flowing within the discharge section 162, such as air deflecting off the various walls 170, 174, 176, 180, may be generally diverted toward the discharge opening 175 upon impacting the deflecting surface 210.

In some embodiments, the angle 208 may be an angle between 15 degrees and 25 degrees, such as 20 degrees. In additional or alternative embodiments, the angle 208 may be formed based on certain parameters of the HVAC unit 100, including a vertical length or height 216 of the discharge section 162, a longitudinal length 218 of the discharge section 162, a flow rate of the air flow 152 directed by the blowers 168 into the discharge section 162, a size of the discharge opening 175, another suitable parameter, or any combination thereof. Furthermore, the angle 208 may be selected based on a position of the blowers 168, such as relative to the base panel 206, to the second wall 174, to the fourth wall 180, to one another, and the like. For instance, the first end 200 may be positioned such that a first vertical distance 220 extending along the height 216 and from the first end 200 to the base panel 206 is greater than a second vertical distance 222 extending along the height 216 and from the first end 200 to a bottom 224 of the blowers 168 or openings 172. In certain implementations, the base panel 206 may be placed on a substantially flat surface, such as the ground, a rooftop, or any other suitable surface. As such, the baffle plate 178 may be sloped relative to the flat surface.

The baffle plate 178 may have a flat or planar cross-sectional shape, but in additional or alternative embodiments, the baffle plate 178 may have another suitable shape, such as a rectangular shape, a triangular shape, or any combination thereof. It should be noted that the deflecting surface 210 of the baffle plate 178 may be planar or level, rather than curved or stepped. However, in additional or alternative embodiments, the deflecting surface 210 may another suitable profile so as to direct the air flow 152 toward the discharge opening 175 and the ductwork 164.

Additionally, in certain implementations, the baffle plate 178 may be formed from a heat conductive material, such as sheet metal, to enable some heat transfer between the baffle plate 178 and the air flow 152 so as to distribute an amount of heat within the air flow 152. As an example, some heat may transfer from initial air flow 152 circulating through the discharge section 162 to the baffle plate 178, and such heat may transfer from the baffle plate 178 to additional air flow 152 circulating through the discharge section 162. However, the walls 170, 174, 176, 180, and/or the base panel 206 may be made from an insulative material to reduce heat transfer between the air flow 152 and an environment external to the HVAC unit 100 so as to maintain an amount of thermal energy within the discharge section 162 and reduce undesirable heat transfer between the air flow 152 and the external environment.

Figure 7:
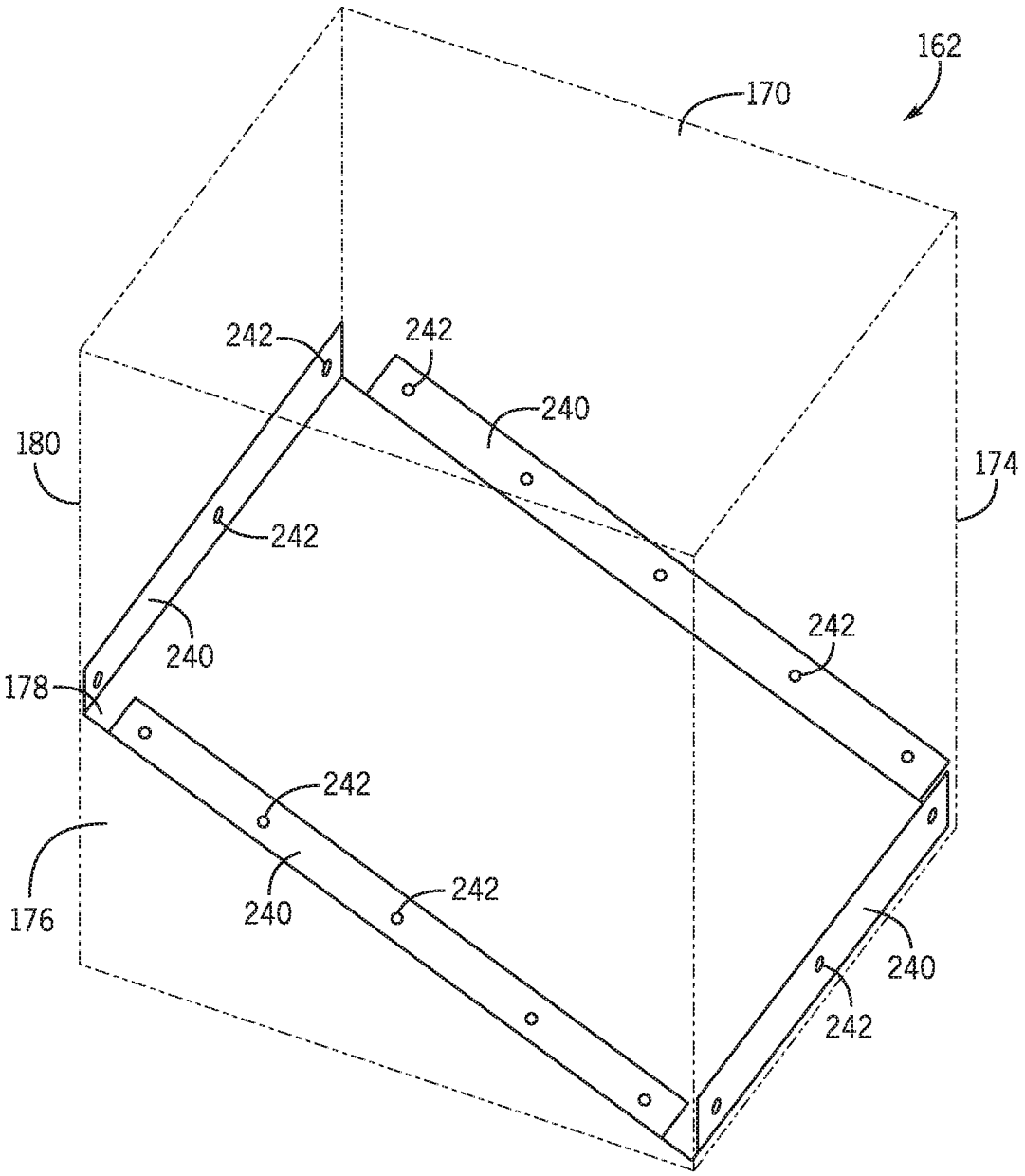
FIG. 7 is a perspective view of an embodiment of a discharge section of an HVAC system having a baffle plate, in accordance with an aspect of the present disclosure.

FIG. 7 is a perspective view of an embodiment of the discharge section 162 having the baffle plate 178. The baffle plate 178 may be coupled or secured within the discharge section 162. For example, the baffle plate 178 may have a plurality of flanges 240, and each flange 240 of the plurality of flanges 240 may have holes 242. The holes 242 may each receive a mechanical fastener that couples the flanges 240 to one of the walls 170, 174, 176, 180 of the discharge section 162. Thus, each flange 240 of the plurality of flanges 240 may be coupled to at least one of the first wall 170, the second wall 174, the third wall 176, or the fourth wall 180. In additional or alternative embodiments, the baffle plate 178 may be coupled to the walls 170, 174, 176, 180 using another suitable component, such as a weld, an adhesive, a tab, or any combination thereof.

The present disclosure may provide one or more technical effects useful in the operation of an HVAC system. For example, the HVAC system may have a baffle plate implemented within a section or chamber through which air may flow. In certain implementations, a blower may direct air into the section, and the section may have a discharge opening through which the air may flow to exit the section, such as toward a space conditioned by the HVAC system. In some embodiments, the section may have a side discharge configuration, in which the blower directs the air toward a wall of the section, rather than directly toward the discharge opening of the section. For this reason, the section may also have a baffle plate configured to divert the air toward the discharge opening. The baffle plate may be positioned within the section to deflect the air to flow into the discharge opening and out of the discharge section. As a result, the baffle plate may increase a flow rate of the air exiting the discharge section and reduce the amount of the air recirculating within the discharge section. Thus, the baffle plate may increase an efficiency of the HVAC system to supply the air, such as for delivering the air to the space. Furthermore, it should be noted that the baffle plate described herein may be retrofitted into existing HVAC systems, such as other discharge sections of the existing HVAC systems. Thus, existing HVAC systems may be modified with the baffle plate to increase a flow rate of air through the existing HVAC systems, thereby improving a performance or efficiency of existing HVAC systems. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a discharge section housing forming a chamber;

a first opening formed in the discharge section housing such that the chamber is configured to receive an air flow from a blower of the HVAC system via the first opening;

a second opening formed in the discharge section housing such that the second opening is positionally offset to the first opening, wherein the chamber is configured to discharge the air flow through the second opening;

a base panel of the discharge section housing oriented crosswise relative to the first opening and oriented crosswise relative to the second opening; and a guide extending across the chamber and sloping toward the second opening such that the guide is configured to direct the air flow from the first opening toward the second opening, wherein the guide forms an acute angle with the base panel.

2. The HVAC system of claim 1, comprising a first wall having the first opening and comprising a second wall having the second opening, wherein the first wall is coupled to the second wall.

3. The HVAC system of claim 2, wherein the guide is disposed at an oblique angle relative to the second wall.

4. The HVAC system of claim 3, comprising a third wall coupled to the first wall and disposed opposite the second wall, wherein the guide extends across the chamber from the second wall to the third wall, and the guide is disposed at an oblique angle relative to the third wall.

5. The HVAC system of claim 4, comprising a fourth wall disposed opposite the first wall, wherein the guide is coupled to the first wall, the second wall, the third wall, and the fourth wall.

6. The HVAC system of claim 5, wherein the guide comprises a plurality of flanges, and each flange of the plurality of flanges is coupled to one of the first wall, the second wall, the third wall, or the fourth wall.

7. The HVAC system of claim 1, comprising a third opening formed in the discharge section housing such that the chamber is configured to receive an additional air flow from an additional blower of the HVAC system via the third opening.

8. The HVAC system of claim 1, wherein the guide is a planar baffle plate.

9. The HVAC system of claim 1, wherein the acute angle is between 15 degrees and 25 degrees.

10. The HVAC system of claim 1, wherein the first opening is oriented substantially perpendicularly relative to the second opening.

11. The HVAC system of claim 1, wherein the guide is formed from sheet metal.

12. The HVAC system of claim 1, wherein the discharge section housing does not include heat exchanger tubes.

13. A heating, ventilation, and/or air conditioning (HVAC) unit, comprising:

a discharge chamber having a first wall defining an opening and a second wall connected to the first wall and defining a discharge opening;

a blower coupled to the first wall and configured to direct air into the discharge chamber via the opening;

a base panel of the discharge chamber disposed crosswise relative to the opening of the first wall and disposed crosswise relative to the discharge opening of the second wall; and a baffle plate disposed within the discharge chamber and extending along the first wall, wherein the baffle plate is positioned at an oblique angle relative to the second wall to deflect the air within the discharge chamber toward the discharge opening, and the baffle plate forms an acute angle with the base panel.

14. The HVAC unit of claim 13, comprising a third wall connected to the second wall and disposed opposite the first wall, wherein the blower is configured to direct the air through the opening of the first wall and toward the third wall of the discharge chamber.

15. The HVAC unit of claim 13, comprising:

an intermediate section partially defined by the first wall and fluidly coupled to the discharge chamber; and an evaporator disposed within the intermediate section, wherein the blower is positioned within the intermediate section downstream of the evaporator relative to a flow direction of air through the intermediate section, and the blower is configured to draw the air into the intermediate section and to force the air into the discharge chamber.

16. The HVAC unit of claim 15, comprising a filter disposed within the intermediate section upstream of the evaporator relative to the flow direction of air through the intermediate section.

17. The HVAC unit of claim 13, comprising ductwork fluidly coupled to the second wall of the discharge chamber, wherein the ductwork is configured to receive air from the discharge chamber via the discharge opening.

18. The HVAC unit of claim 13, wherein the baffle plate is configured to couple to the first wall, the second wall, or both, via mechanical fasteners.

19. The HVAC unit of claim 13, wherein the base panel is coupled to the first wall and is coupled to the second wall.

20. A discharge section of a heating, ventilation, and/or air conditioning (HVAC) unit, comprising:

a first wall defining a first opening configured to receive an air flow from a blower of the HVAC unit;

a second wall coupled to the first wall and defining a second opening configured to discharge the air flow from the discharge section;

a third wall connected to the first wall and disposed opposite the second wall;

a base panel coupled to the first wall and the second wall; and a baffle plate coupled to the first wall and the second wall and disposed at an acute angle relative to the base panel to deflect the air flow within the discharge section toward the second opening, wherein the baffle plate has a first end connected to the third wall and a second end connected to the base panel or the second wall, such that a deflecting surface of the baffle plate faces the second opening.

21. The discharge section of claim 20, wherein the second end of the baffle plate is connected to the base panel and the second wall.

22. The discharge section of claim 20, wherein the first end of the baffle plate is connected to the third wall such that a first height extending between the first end of the baffle plate and the base panel is greater than a second height extending between the first end and the first opening.

23. The discharge section of claim 20, comprising a fourth wall connected to the second wall and the third wall, wherein the baffle plate is positioned within the discharge section to form a space between the baffle plate and the base panel, and the baffle plate is coupled to the first wall, the second wall, the third wall, and the fourth wall to substantially block air from entering the space.

24. The discharge section of claim 23, wherein the first wall, the second wall, the third wall, and the fourth wall include an insulative material.

* * * * *